US010981284B2

(12) United States Patent
Delplanche

(10) Patent No.: US 10,981,284 B2
(45) Date of Patent: Apr. 20, 2021

(54) OUT THE FRONT KNIFE

(71) Applicant: Benchmade Knife Co., Inc., Oregon City, OR (US)

(72) Inventor: Mark Delplanche, Oregon City, OR (US)

(73) Assignee: Benchmade Knife Co., Inc., Oregon City, OR (US)

( * ) Notice: Subject to any disclaimer, the term of this patent is extended or adjusted under 35 U.S.C. 154(b) by 36 days.

(21) Appl. No.: 16/192,247

(22) Filed: Nov. 15, 2018

(65) Prior Publication Data

US 2020/0156268 A1 May 21, 2020

(51) Int. Cl.
*B26B 1/08* (2006.01)
*B26B 1/10* (2006.01)

(52) U.S. Cl.
CPC . *B26B 1/08* (2013.01); *B26B 1/10* (2013.01)

(58) Field of Classification Search
CPC ..... B26B 1/08; B26B 1/10
USPC ..... 30/162–163
See application file for complete search history.

(56) References Cited

U.S. PATENT DOCUMENTS

| | | | | |
|---|---|---|---|---|
| 1,024,749 | A | 4/1912 | Sjoberg | |
| 7,178,244 | B2 | 2/2007 | Fossella | |
| 7,305,769 | B2 | 12/2007 | McHenry et al. | |
| 7,574,804 | B2 | 8/2009 | Bezold et al. | |
| 7,686,710 | B2 | 3/2010 | Leiber et al. | |
| 7,797,838 | B2 | 9/2010 | Chu | |
| D666,887 | S | 9/2012 | Wattenberg | |
| 8,595,941 | B2 * | 12/2013 | Lee | B26B 1/08 30/151 |
| 8,966,771 | B2 * | 3/2015 | Chu | B26B 1/08 30/162 |
| 9,056,398 | B2 | 6/2015 | Liao | |
| 9,174,347 | B2 | 11/2015 | Hongquan et al. | |
| 9,676,105 | B2 | 6/2017 | McChesney | |
| 2009/0235534 | A1 * | 9/2009 | Chu | B26B 1/08 30/162 |
| 2010/0223793 | A1 | 9/2010 | Hansen et al. | |
| 2012/0255179 | A1 * | 10/2012 | Moizis | B26B 1/08 30/162 |
| 2013/0174423 | A1 * | 7/2013 | Liao | B26B 1/08 30/162 |
| 2014/0101943 | A1 | 4/2014 | Chu | |
| 2017/0050325 | A1 | 2/2017 | Lee | |

FOREIGN PATENT DOCUMENTS

| | | |
|---|---|---|
| GB | 2432806 A | 6/2007 |
| TW | 200734142 A | 9/2007 |
| TW | M511938 U | 11/2015 |

* cited by examiner

*Primary Examiner* — Kenneth E Peterson
*Assistant Examiner* — Nhat Chieu Q Do
(74) *Attorney, Agent, or Firm* — Schwabe, Williamson & Wyatt, P.C.

(57) ABSTRACT

An out the front (OTF) knife, including a handle, a blade slider mechanism, and a blade. The blade slider mechanism including: a liner having a longitudinal central channel and a first outer surface and a second outer surface opposite the first surface; a tang portion of the blade configured to ride along the first outer surface; and a slider coupled to the tang and having a portion configured to travel in the central channel of the liner and one or more portions configured to ride along the second outer surface, and wherein the liner is slideably captured between tang and the slider.

14 Claims, 8 Drawing Sheets

OUT THE FRONT KNIFE

TECHNICAL FIELD

This invention relates to knives equipped with blades that open automatically, and more particularly to "out-the-front" knives in which the blade opens and closes by sliding longitudinally into and out of the front of the handle.

BACKGROUND

In typical designs, out-the-front knives, referred to herein as OTF knives, are inherently weaker than folding knives when the blades are in the open or extended position. Folding knives almost always have at least two very strong points of connection or interaction between the blade and the handle. The first point of connection is the highly secure connection between the handle and the blade at the blade pivot point. The second point of connection is between the tang of the blade and a blade stop in the handle that contacts the tang of the blade and stops the blade's rotation when the blade is rotated into the open position. These two strong points of connection result in folding knives that have very strong blade-to-handle connectivity. The result is that the blade is very securely held in the open position with a minimal amount of blade wobble relative to the handle.

An OTF knife completely lacks the primary stabilizing feature of folding knives, namely the connection at the blade pivot point. Indeed, in almost all OTF knives, the blade travels freely in the handle at least at some point during both the opening and closing motions. As a result, OTF knives are notoriously weak and the blades are very prone to wobble when the blade is in the open position. Although OTF knives include locks to secure the blade in the open position, the locks tend to provide relatively little support for the blade. Typically, there are only one and at most two points of interconnection between the handle and the blade. The result is that most OTF knives are little more than novelties, ill-suited for tactical operations and serious work that requires a strong knife. The following disclosure solves those and other problems.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1:
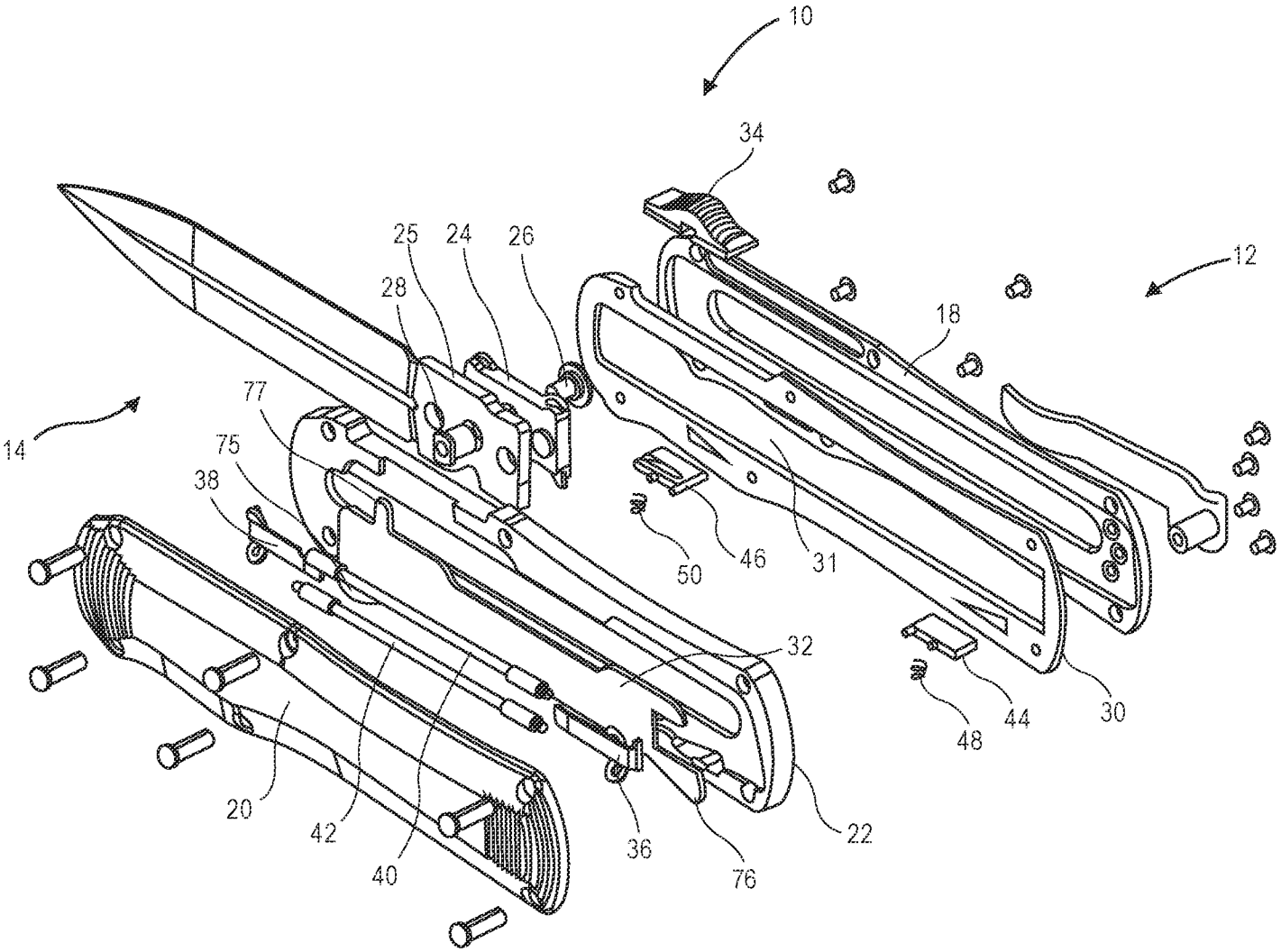
FIG. 1 is a perspective and exploded view of an out-the-front (OTF) knife, in accordance with various embodiments.

In the following detailed description, reference is made to the accompanying drawings, which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments.

Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

On current production out the front (OTF) knives, the handles of the knife provide the structure and support to control the sliding motion of the blade. However, this limits the materials available for the handles. As discussed above, with many OTF knife designs, the mechanism that locks the blade open is inherently weak.

In contrast to previous designs, the OTF knife described herein provides an extremely strong interconnection between the handle and the blade by providing multiple points of interconnection between the handle and the blade when the blade is in the open position. These multiple points of connection result in an extremely strong blade/handle combination. In addition, on many OTF knives, the latches that maintain the position of the blade in either the secured or deployed position are located in the plane of the knife blade; the springs for the latches are in the same plane. This requires the handle to cover the area in the plane of the blade and to provide support for the latch springs. As will become apparent from the detailed discussion below, one of the benefits of the disclosed OTF knife design is that at allows these springs to be moved from the blade plane to give a sleeker look that is easier to clean and maintain.

To overcome the problem noted above, the inventor has developed a novel liner and slider mechanism that provides an incredibly strong connection between the blade/slider combination and the liner (which is retained by the handle). By capturing the liner between the slider and the blade, other components normally found in an OTF knife can be eliminated from the slide action. Because the slider/blade/liner combination is separate from the remainder of the handle, the handle sides are not structural components of the mechanism. This allows for more material options for handles. By constructing the slide mechanism in this fashion, only the liner and slider are critical to controlling blade play (side to side & up/down). These two components, with the latches added, control the lockup and minimize the in and out play. In addition, the springs for the latches can be located out of the blade/latch plane, which allows for the handle to be completely open in the plane of the blade for ease of maintenance and cleaning, as well as being aesthetically pleasing.

Aspects of the present disclosure concern an out the front knife. In embodiments, the OTF knife includes a handle and a blade. In certain embodiments, the blade includes a sharpened portion and a tang or tang portion. In embodiments, the handle includes a liner having a longitudinal central channel and a first outer surface and a second outer surface opposite the first surface. In embodiments, the liner is disposed within the handle.

In embodiments, the blade includes a tang portion configured to ride along the first outer surface of the liner. In embodiments, the handle includes a slider coupled to the tang and having a portion configured to travel in the central channel of the liner and one or more portions configured to ride along the second outer surface of the liner. In embodiments, the liner is slideably captured between the tang and the slider.

In certain embodiments, the slider includes a first pair of upper bumpers disposed on an upper edge of the slider and a second pair of lower bumpers disposed on a lower edge of the slider and configured to ride along inside surfaces of the central channel of the liner. In certain embodiments, the slider includes an upper pair of side retainers disposed on an upper edge of the slider and a lower pair of side retainers disposed on a lower edge of the slider and configured to ride along the outer surface of the liner. It is this set of upper and lower bumpers and side retainers that work together with the liner to effectively provide the multiple points of contact leading to the incredibly strong interconnection between the blade and the handle.

In certain embodiments, the handle includes a first handle side wall coupled to the liner and a second handle side wall coupled to the liner, wherein the liner is disposed between the first handle side wall and the second handle side wall. In certain embodiments, the handle further includes a spacer coupled to the liner and disposed between the liner and the second handle side wall.

In certain embodiments, the OTF knife includes a blade firing mechanism. In certain embodiments, the blade firing mechanism includes a carriage slideably disposed within the handle. In certain embodiments, the blade firing mechanism includes a trigger button coupled to the carriage. In certain embodiments, the carriage includes two ramped tabs that are configured to push latches out of the way to release the blade. In certain embodiments, the blade firing mechanism includes an open latch and close latch configured to retain the blade in an open or closed position, respectively. In certain embodiments, the open latch and the close latch are biased to a latched configuration by one or more biasing members, such as one or more springs, for example one or more compression or leaf springs. In certain embodiments, the one or more biasing members are offset from the plane of the blade. In certain embodiments, the blade firing mechanism includes one or more springs for tensioning the blade firing mechanism. In certain embodiments, the blade firing mechanism includes a rearward catch and a forward catch coupled to the one or more springs and configured to propel the knife to a deployed position and a closed position, respectively.

Aspects of the disclosure further concern a blade slider mechanism for an out the front (OTF) knife. In embodiments, the blade slider mechanism includes a liner having a longitudinal central channel and a first outer surface and a second outer surface opposite the first surface. In embodiments, the blade slider mechanism includes a blade comprising a tang portion configured to ride along the first outer surface of the liner. In embodiments, the blade slider mechanism includes a slider coupled to the tang and having a portion configured to travel in the central channel of the liner and one or more portions configured to ride along the second outer surface, and wherein the liner is slideably captured between tang and the slider.

In embodiments, the slider includes a first pair of upper bumpers disposed on an upper edge of the slider and a second pair of lower bumpers disposed on a lower edge of the slider and configured to ride along inside surfaces of the central channel of liner. In embodiments, the slider includes an upper pair of side retainers disposed on an upper edge of the slider and a lower pair of side retainers disposed on a lower edge of the slider and configured to ride along the outer surface of the liner. In embodiments, the tang and the slider include one or more locater pins and locator holes to align the tang and the slider. In embodiments, the blade further includes a sharpened portion.

Figure 2:
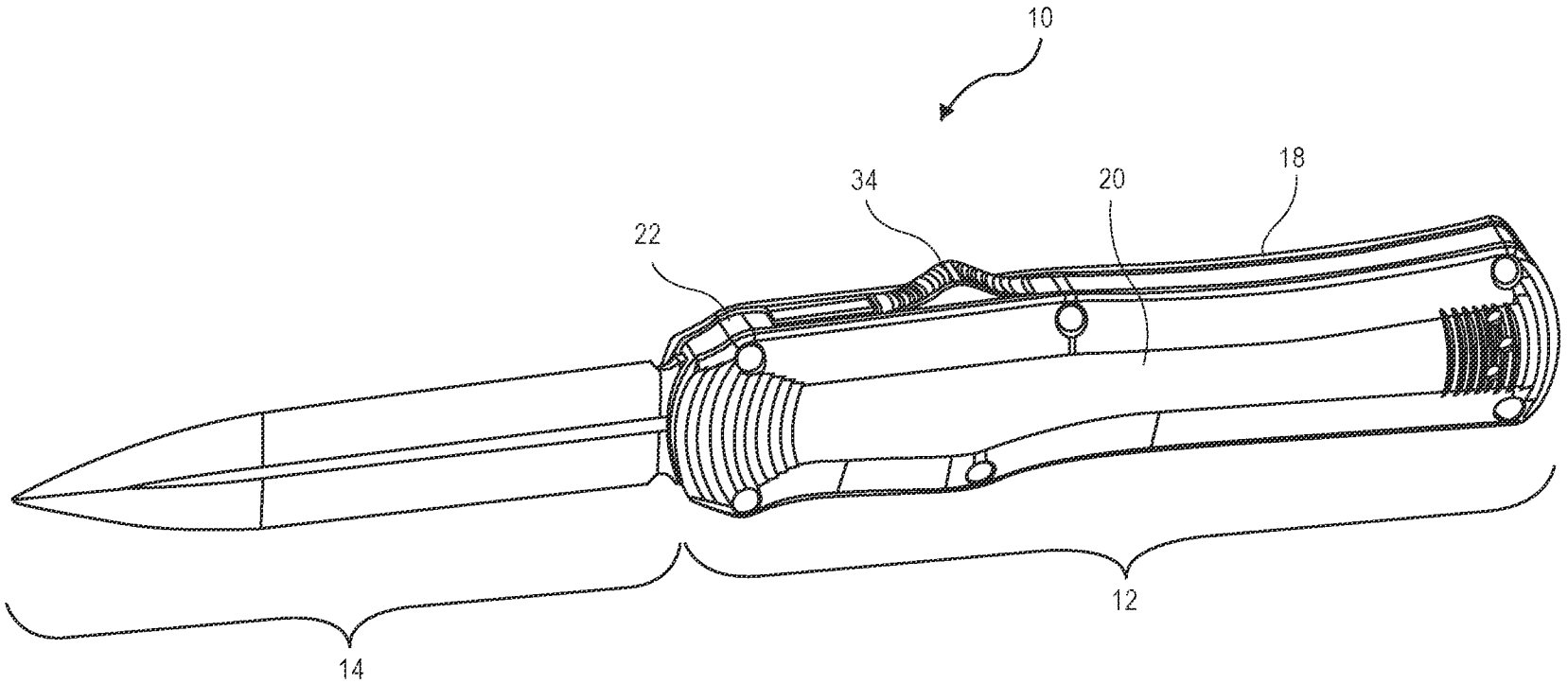
FIG. 2 is a perspective view of an assembled OTF knife with the blade in an extended position, in accordance with various embodiments.
Figure 7:
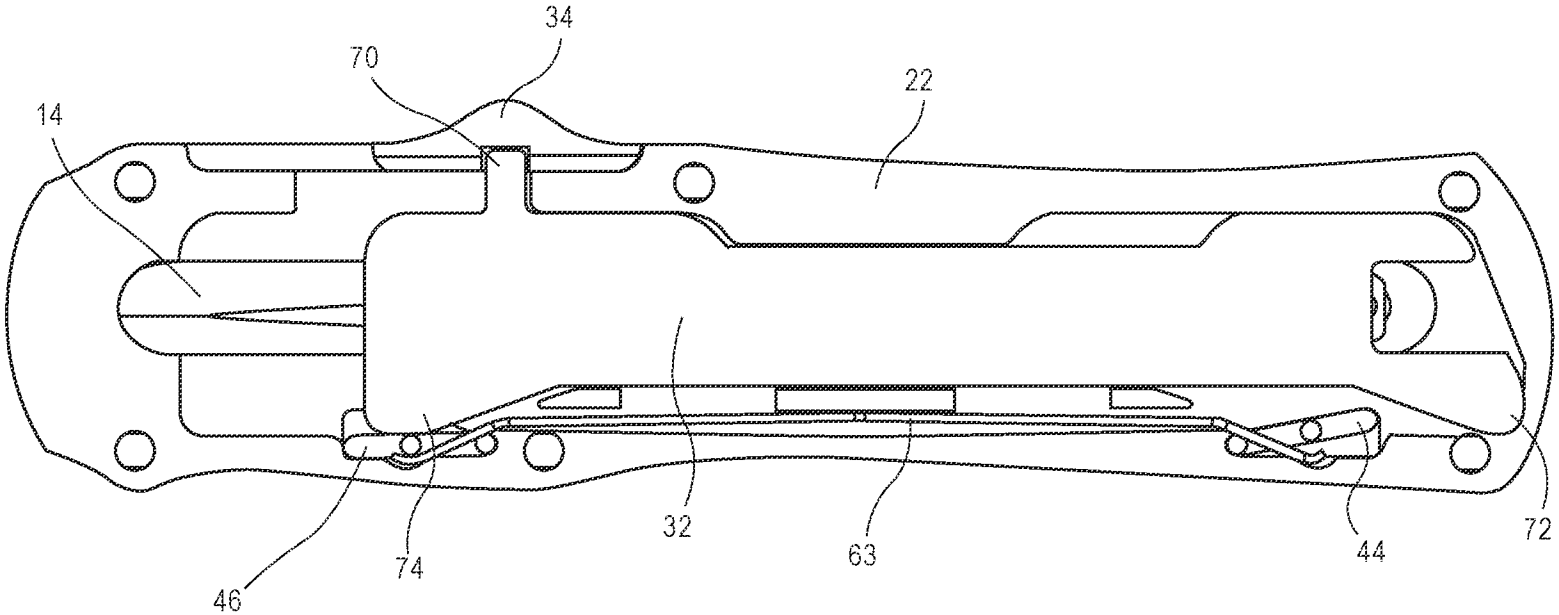
FIG. 7 is a side elevation view of a trigger and spacer components of a partially assembled OTF knife, in accordance with various embodiments.
Figure 8:
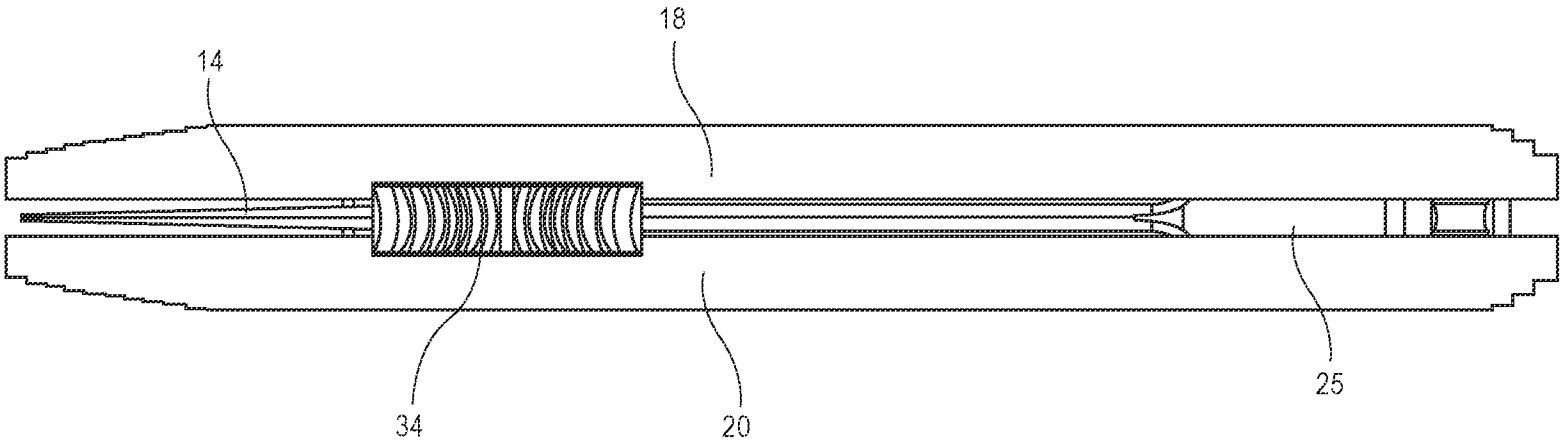
FIG. 8 is a top view of an assembled OTF knife with the blade in a retracted position, in accordance with various embodiments.

Turning to the Figures, embodiments of an OTF knife 10 in accordance with the illustrated embodiments are shown in FIGS. 1 through 8. The primary components of knife 10 are a handle 12 and a blade 14. The handle includes a first handle half 18 and a second handle half 20. The handle halves 18 and 20 are held apart from each other and mated to a spacer 22 for example with fasteners, such as screws positioned around the periphery of the handle halves 18 and 22. One of the unique features of the disclosed OTF knife that differentiates it from other OTF knives is that the handle halves 18 and 20 do not form structural components of the sliding mechanism of the OTF knife, thus various materials can be used for the handle halves, including metal, wood, and/or plastic. When assembled together as shown in FIGS. 2 and 8, the two handle halves 18 and 20 and the spacer 22 define a blade-receiving cavity that receives blade 14 when it is in the retracted position. Blade 14 is movable longitudinally in handle 12 between a closed position shown in FIG. 8 and an open position of shown in FIG. 2.

Figure 3:
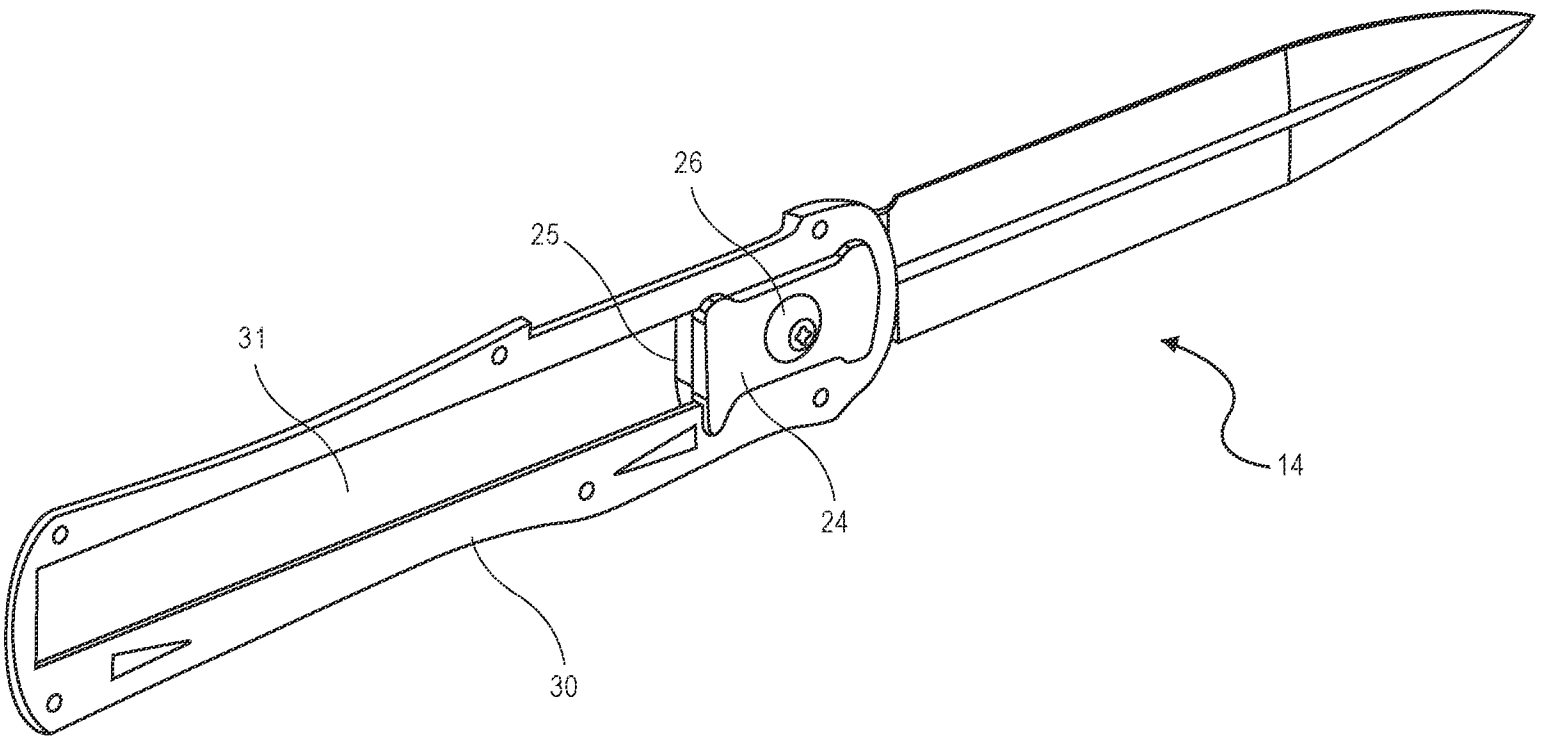
FIG. 3 is a perspective view of the blade and liner of a partially assembled OTF knife with the blade in an extended position, in accordance with various embodiments.

Returning to FIG. 1 the handle 12 of the OTF knife 10 further includes a liner 30 having a central channel 31. The liner 30 is retained between the handle halves 18 and 20. The handle 12 includes the automatic closing and opening mechanism, which includes a carriage 32, a trigger button 34, the spring catches 36 and 38, and the springs 40 and 42. The blade 14 can be divided into the working or sharpened portion and the tang portion 25. The tang portion 25 in conjunction with a slider 24 capture the liner 30 between the tang portion 25 and the slider 24, for example as held together with screw 26 and nut 28. As best seen in FIG. 3, during longitudinal movement of the blade, the slider 24 moves within the channel 31.

As best seen in FIG. 2, the front or blade end of the spacer 22 of the handle 12 includes a notch which allows the blade 14 to move in and out of the handle 12. The end of handle 12 longitudinally opposite front end of the handle 12 is generally referred to as rearward or back end. The trigger button 34 protrudes from what can be referred to as the top of the handle, and is configured to move back and forth to actuate the automatic deployment and retraction of the blade 14. As discussed above, the components of the trigger mechanism are shown in FIG. 1. Trigger button 34 acts as the firing trigger. With reference to FIG. 7, the blade 14 is shown in the closed position and trigger button 34 is positioned at the rearward end of an elongate groove formed in the upper surface of the spacer 22. When blade 14 is in the open position as seen in FIG. 2, trigger button 34 is slid in a groove toward the forward end of the groove. Relative directional terms used herein are based upon the "forward" end of handle 12, and rearward end of handle 12. Likewise, "upper" or "top" refers to the direction toward the top of the spacer 22 that houses the trigger mechanism and "lower" or "bottom" refers to the direction on the opposite side of the spacer 22. The spacer 22 includes a longitudinal cavity that that is configured to slideably receive a carriage 32, which is part of the blade activation mechanisms and interconnects between the trigger mechanism and the components of the latching and firing mechanisms. The carriage 32 includes on its top edge a tab 77 that is positioned to provide a direct connection between trigger button 34 and carriage 32. On the bottom edge of the carriage 32 are two ramped tabs 75 and 76 that are configured to push latches 44 and 46 out of the way to release the blade 14, either to deploy or retract the blade 14, respectively. As the trigger button 34 is moved, it in turn causes a carriage 32 to move which depending whether it is being moved forward or rearward cocks the trigger mechanism for deployment or retraction, respectively. The latches 44 and 46 are biased upward, for example with springs 48 and 50, or as shown in FIG. 7 with leaf spring 63. In embodiments, the spring 63 is located out of the plane of the blade 14, to provide for a clean look (see FIG. 8) that further provides for ease of cleaning. The latches 44 and 46 prevent the movements of the blade 14 until the trigger button 34 is actuated. The rearward catch 36, the forward catch 38, and the springs 40 and 42 work in concert to store and release energy to either drive the blade 14 to a closed or deployed position depending on which direction the trigger button 34 is actuated.

Figure 4:
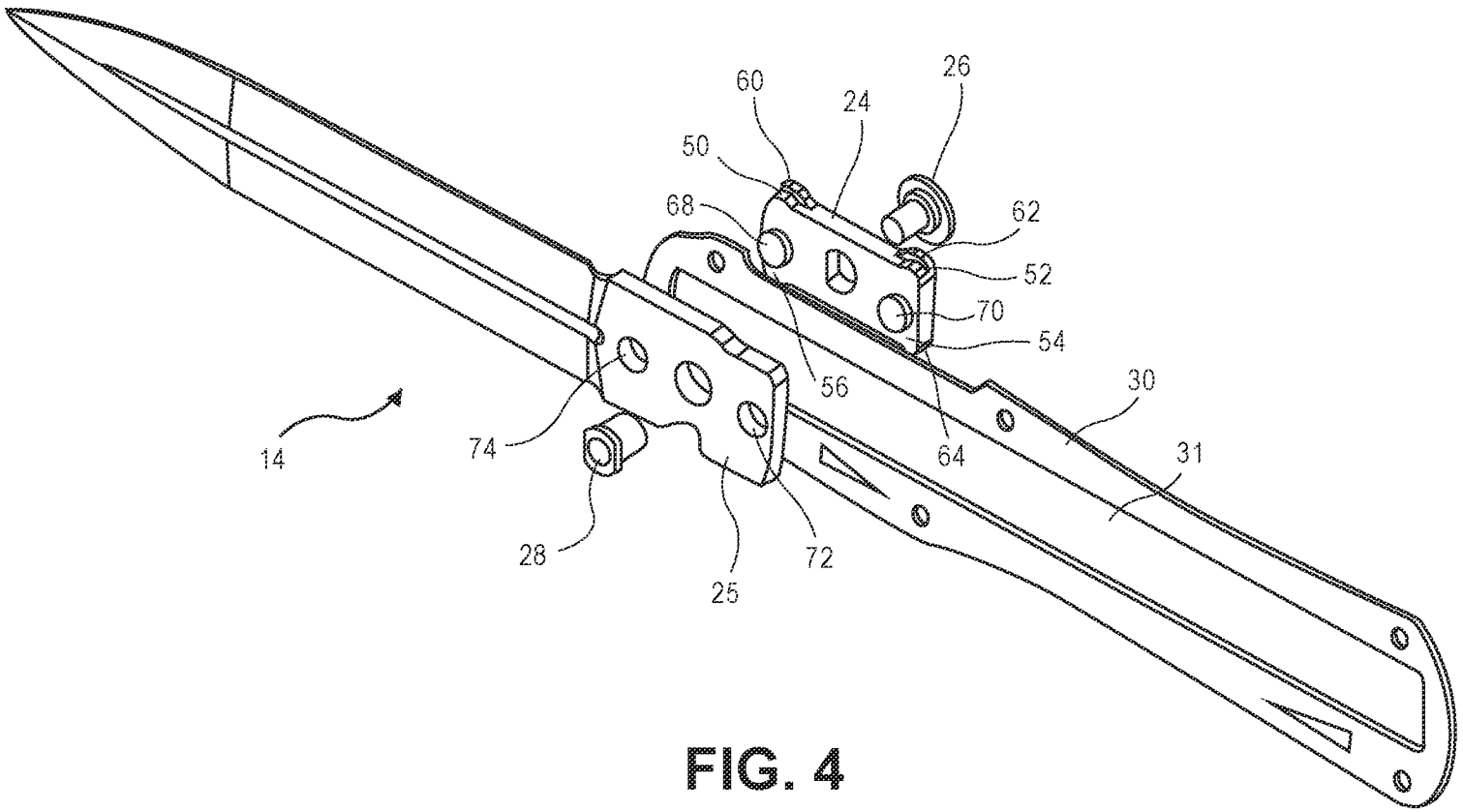
FIG. 4 is a perspective and exploded view of the blade and liner of an OTF knife, in accordance with various embodiments.
Figure 5:
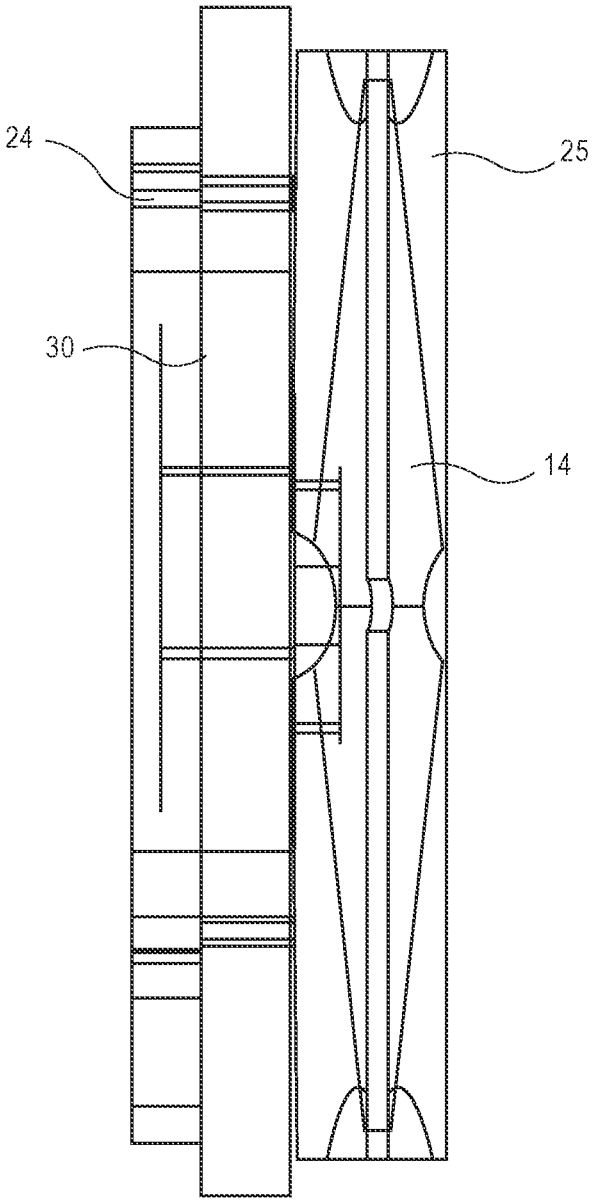
FIG. 5 is a front view of the blade and liner of a partially assembled OTF knife, in accordance with various embodiments.
Figure 6:
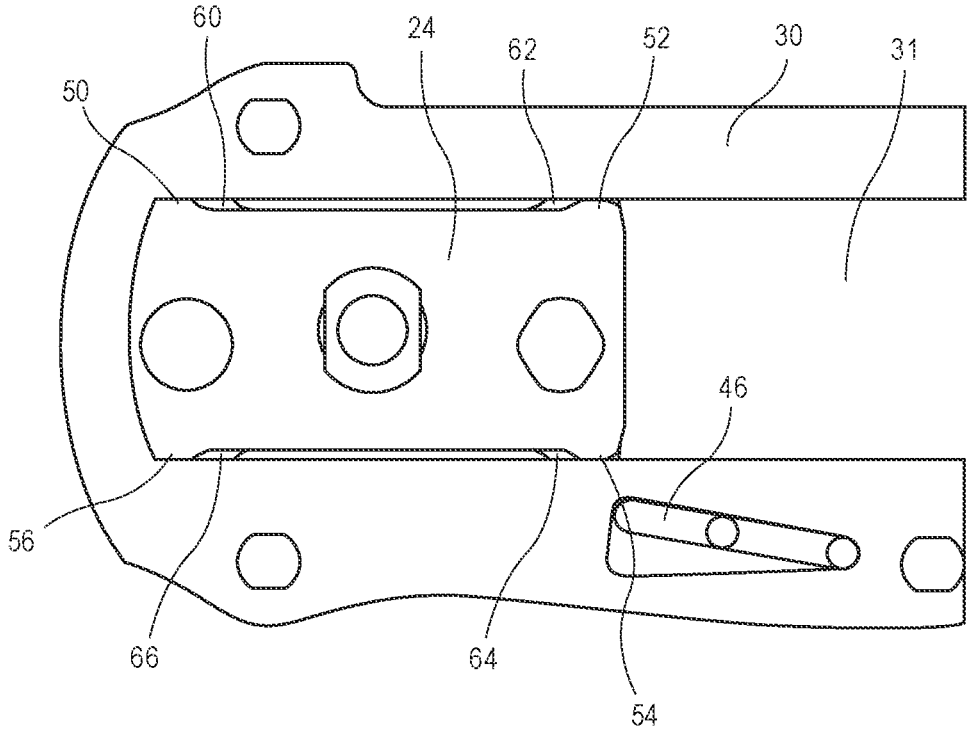
FIG. 6 is a side elevation view of the slider and liner of a partially assembled OTF knife, in accordance with various embodiments.

One of the unique features of the disclosed OTF knife 10 is the sliding mechanism that allows the blade 14 to be deployed or retracted while maintaining a strong and rigid connection between the blade 14 and the handle 12. The details of this sliding mechanism are best seen in FIGS. 3-6. The sliding mechanism includes the liner 30 having the central channel 31. Slideably retained within the central channel 31 of the liner 30 is the slider 24. The slider 24 is able to slide back and forth within the central channel 31 of the liner 30, for example when the blade is being deployed or retracted as discussed above. The slider 24 is held in place by sandwiching the liner 30 between the slider 24 and the tang 25. With reference to FIG. 4, the tang 25 of the blade 14 and the slider 24 include several features that allow for the liner 30 to provide strong and rigid location holes 72 and 74 that mate with corresponding location pins 68 and 70 on the slider 24 when the slider 24, liner 30, and tang 25 are assembled. The combination of the location pins 68 and 70 and location holes 72 and 74 provide for a strong and rigid connection between the blade 14 and the slider 24. In addition, the slider 24 includes features that allow for a tight and strong connection between the blade 14, tang 25, slider 24, and the liner 30. The slider 24 includes a first pair of upper bumpers 50 and 52 and a second pair of lower bumper 54 and 56 on either side, top and bottom respectively of the slider 24. The first pair of upper bumpers 50 and 52 and the second pair of lower bumpers 54 and 56 ride along the inside surface of the central channel 31 of liner 30 and provides for a strong and tight connection between the slider 24 and the liner 30. The first pair of upper bumpers 50 and 52 and the second pair of lower bumpers 54 and 56 are configured to provide minimal friction between the central channel 31 and the first pair of upper bumpers 50 and 52 and the second pair of lower bumper 54 and 56 while still providing for a tight fit, for example having a gap tolerance of less than about a thousandth of an inch. The first pair of upper bumpers 50 and 52 and the second pair of lower bumper 54 and 56 prevent the blade 14 from any substantial rotation in the lateral plane, i.e. the plane of the blade. The slider 24 further includes an upper pair of side retainers 60 and 62 and a lower pair of side retainers 64 and 66. The upper pair of side retainers 60 and 62 and the lower pair of side retainers 64 and 66 work together with the tang 25 of the blade 14 to capture and secure the blade 14 to the liner 30. When the blade 14 is in motion the tang 15 and the upper pair of side retainers 60 and 62 and the lower pair of side retainers 64 and 66 glide across the outsides of the liner 30. The upper pair of side retainers 60 and 62 and the lower pair of side retainers 64 and 66 are configured to provide minimal friction between the liner 30 and the upper pair of side retainers 60 and 62 and the lower pair of side retainers 64 and 66 while still providing for a tight fit, for example having a gap tolerance of less than about a thousandth of an inch. The upper pair of side retainers 60 and 62 and the lower pair of side retainers 64 and 66 prevent the blade 14 from any substantial rotation in the transverse plane, i.e. transverse to the plane of the blade.

It will be appreciated that various substitutions and modifications may be made without departing from the scope of the invention defined in the claims. Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. An out the front (OTF) knife, comprising:

a handle, comprising a liner having a longitudinal central channel and a first outer surface and a second outer surface opposite the first surface;

a blade, comprising a tang portion configured to ride along the first outer surface; and a slider coupled to the tang and having a central portion configured to travel in the central channel of the liner and an outer portion configured to ride along the second outer surface, wherein the liner is slideably captured between the tang and the slider, wherein the outer portion comprises an upper pair of side retainers extending from an upper edge of the outer portion and a lower pair of side retainers extending from a lower edge of the outer portion and configured to ride along the second outer surface of the liner, and wherein the central portion of the slider comprises a first pair of upper bumpers extending from an upper edge of the central portion of the slider and a second pair of lower bumpers extending from a lower edge of the central portion of the slider and configured to ride along inside surfaces of the longitudinal central channel of the liner.

2. The OTF knife of claim 1, wherein the blade further comprises a sharpened portion.

3. The OTF knife of claim 1, wherein the handle further comprises:

a first handle side wall coupled to the liner; and a second handle side wall coupled to the liner, wherein the liner is disposed between the first handle side wall and the second handle side wall.

4. The OTF knife of claim 3, further comprising a spacer coupled to the liner and disposed between the liner and the second handle side wall.

5. The OTF knife of claim 1, further comprising a blade firing mechanism.

6. The OTF knife of claim 5, wherein the blade firing mechanism comprises a carriage slideably disposed within the handle.

7. The OTF knife of claim 6, wherein the blade firing mechanism comprises a trigger button coupled to the carriage.

8. The OTF knife of claim 6, wherein the carriage comprises two ramped tabs that are configured to push latches out of the way to release the blade.

9. The OTF knife of claim 5, wherein the blade firing mechanism comprises an open latch and a close latch configured to retain the blade in open or closed positions, respectively.

10. The OTF knife of claim 9, wherein the open latch and the close latch are biased to a latched configuration by one or more biasing members.

11. The OTF knife of claim 10, wherein the one or more biasing members are offset from the plane of the blade.

12. A blade slider mechanism for an out the front (OTF) knife, comprising:

a liner having a longitudinal central channel and a first outer surface and a second outer surface opposite the first surface;

a blade, comprising a tang portion configured to ride along the first outer surface; and a slider coupled to the tang and having a central portion configured to travel in the central channel of the liner and an outer portion configured to ride along the second outer surface, wherein the liner is slideably captured between the tang and the slider, wherein the outer portion comprises an upper pair of side retainers extending from an upper edge of the outer portion and a lower pair of side retainers extending from a lower edge of the outer portion and configured to ride along the second outer surface of the liner, wherein the central portion of the slider comprises a first pair of upper bumpers extending from an upper edge of the central portion of the slider and a second pair of lower bumpers extending from a lower edge of the central portion of the slider and configured to ride along inside surfaces of the longitudinal central channel of the liner.

13. The blade slider mechanism of claim 12, wherein the tang and the slider comprises one or more locater pins and locator holes to align the tang and the slider.

14. The blade slider mechanism of claim 12, wherein the blade further comprises a sharpened portion.

* * * * *